US006811064B2

(12) United States Patent
Salem

(10) Patent No.: US 6,811,064 B2
(45) Date of Patent: Nov. 2, 2004

(54) ADJUSTABLE CLOTHING HANGER

(75) Inventor: Charles L. Salem, c/o Salem System Solutions, 1020 31st St., Suite 135, Downers Grove, IL (US) 60515

(73) Assignee: Charles L. Salem, Aurora, IL (US)

( * ) Notice: Subject to any disclaimer, the term of this patent is extended or adjusted under 35 U.S.C. 154(b) by 0 days.

(21) Appl. No.: 10/202,177

(22) Filed: Jul. 24, 2002

(65) Prior Publication Data

US 2004/0016779 A1 Jan. 29, 2004

(51) Int. Cl.[7] ..... A41D 27/22
(52) U.S. Cl. ..... 223/94
(58) Field of Search ..... 223/94, 89, 85

(56) References Cited

U.S. PATENT DOCUMENTS 2,335,285 A * 11/1943 Kinney ..... 223/89
3,695,492 A * 10/1972 Sheba ..... 223/94
4,333,590 A * 6/1982 Princiotta ..... 223/85
5,052,599 A 10/1991 Platti
5,085,358 A * 2/1992 Lam ..... 223/94
5,102,019 A 4/1992 Lam
5,104,083 A 4/1992 Shannon
5,476,199 A 12/1995 Halverson et al.
5,711,464 A 1/1998 Huang
5,718,362 A * 2/1998 Silverman ..... 223/94
5,758,806 A 6/1998 Anderson
6,003,743 A 12/1999 Deady
6,053,379 A 4/2000 Balph
6,076,716 A * 6/2000 Reyes ..... 224/482
6,164,504 A * 12/2000 Richard ..... 223/94

* cited by examiner

*Primary Examiner*—John J. Calvert
*Assistant Examiner*—James G Smith
(74) *Attorney, Agent, or Firm*—The Law Office of Randall T. Erickson, P.C.

(57) ABSTRACT

An adjustable garment hanger comprises a hanger body having legs extending in a hanger widthwise direction. First and second leg extensions are each adjustably engaged to a leg of the hanger body to determine an overall width along the widthwise direction of the garment hanger. A collar support extends upwardly from the hanger body. The collar support comprises first and second posts, each extending at an angle to a respective one of the legs. The first and second posts are spaced apart by a distance approximating the widthwise dimension of a garment collar. A spacer extends on opposite sides of the hook-shaped member in a horizontal, profile direction that is perpendicular to the widthwise direction. The spacer has a thickness along the horizontal, profile direction approximately equal to an overall thickness of the leg extensions taken along the horizontal, profile direction. The spacer functions to space the hanger centerline from centerlines of adjacent hangers hung on a common rod to prevent excessive contact on a garment hung on the hanger by adjacent hung garments.

26 Claims, 2 Drawing Sheets

ADJUSTABLE CLOTHING HANGER

TECHNICAL FILED OF THE INVENTION

The invention relates to hangers for holding garments in an upright position supported from a rod or hook. Particularly, the invention relates to an adjustable hanger that is adjustable in width to accommodate clothing of variable size.

BACKGROUND OF THE INVENTION

Clothing hangers having some means of adjusting the effective width (shoulder-to-shoulder direction) of the hanger are known, such as described in U.S. Pat. Nos. 5,052,599; 5,085,358; and 5,476,199. These patents described hangers each having a hook-shaped member for hanging a garment from a horizontal rod or hook. The hook-shaped member supports a hanger body that includes leg members having a degree of length adjustability in the widthwise direction.

The present inventor has recognized that it would be advantageous if a clothing hanger not only was adjustable in effective width to more closely correspond to clothing shoulder-to-shoulder width, but would also prevent overall shirt wrinkling caused by contact with other hung garments. The present inventor has recognized that it would be advantageous if a clothing hanger would also prevent pointed wrinkles or sharp creases in the shirt fabric heretofore caused by the shirt being hung on thin wire hangers. The present inventor has recognized that it would be advantageous if a clothing hanger would also prevent wrinkling in the collar and upper chest area of the shirt.

The present inventor has recognized that it would be advantageous if a clothing hanger comprised a shape for supporting a garment such that a garment could be hung to dry on the hanger without drying with pointed wrinkles or sharp creases caused by the garment-supporting surfaces of the hanger.

SUMMARY OF THE INVENTION

The invention includes a garment hanger comprising a hanger body having legs extending along the hanger widthwise direction. The hanger body is connected to a hook-shaped member extending from a central region of the hanger body, the hook-shaped member configured to engage a support rod for suspending the garment hanger. First and second leg extensions are each adjustably engaged to a leg of the hanger body and are selectively extendable from each leg to determine an overall width of the garment hanger. A collar support extends upwardly from the hanger body. The collar support comprises first and second posts, each extending at an angle to a respective one of the legs. The first and second posts are spaced apart by a distance approximating the flat, widthwise dimension of an upstanding garment collar.

The garment hanger further comprises a spacer extending on opposite sides of the hook-shaped member in a horizontal, profile direction that is perpendicular to the widthwise direction, the spacer having a length along the profile direction approximately equal to an overall thickness of the leg extensions taken along the profile direction. The spacer functions to space the hanger centerline from centerlines of adjacent hangers hung on a common rod, to prevent excessive contact from a hung garment with adjacent hung garments. By limiting this contact, garment wrinkling can be substantially reduced.

The legs and the leg extensions have inverted U-shaped cross-sections and are telescopically engaged. One of the legs and leg extensions comprises incrementally spaced-apart notches and the other of the legs and leg extensions comprises at least one lug sized and shaped to fit into a selected one of the notches to adjust the degree of telescopic engagement of the respective leg and leg extensions.

Advantageously, according to one embodiment, the leg extensions have an overall thickness in the profile direction of about one inch. The leg extensions have downwardly angled flared end portions.

The collar support can include a generally horizontal strut connecting together the posts and the hook-shaped member. The posts are spaced apart such that the overall width in the widthwise direction of the collar support is approximately four inches. The posts extend vertically from the legs to a height of about one inch. The posts and the strut can be formed together as a curved arch.

The legs and the leg extensions together comprise plural notches and engagement lugs applied on opposite ones of the legs and leg extensions and are in a quantity such that an excess number of either notches or lugs are present to provide for an incremental adjustability in the overall dimension, along the hanger widthwise direction, of the legs and leg extensions.

The hook-shaped member is preferably in the form of an arcuate wire or rod, and the posts and the strut are in wire or rod form and comprises a substantially equal material thickness as the hook-shaped member. The hook-shaped member and the collar support are preferably molded in unitary fashion of a plastic material, and the leg extensions are also preferably composed of plastic material.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
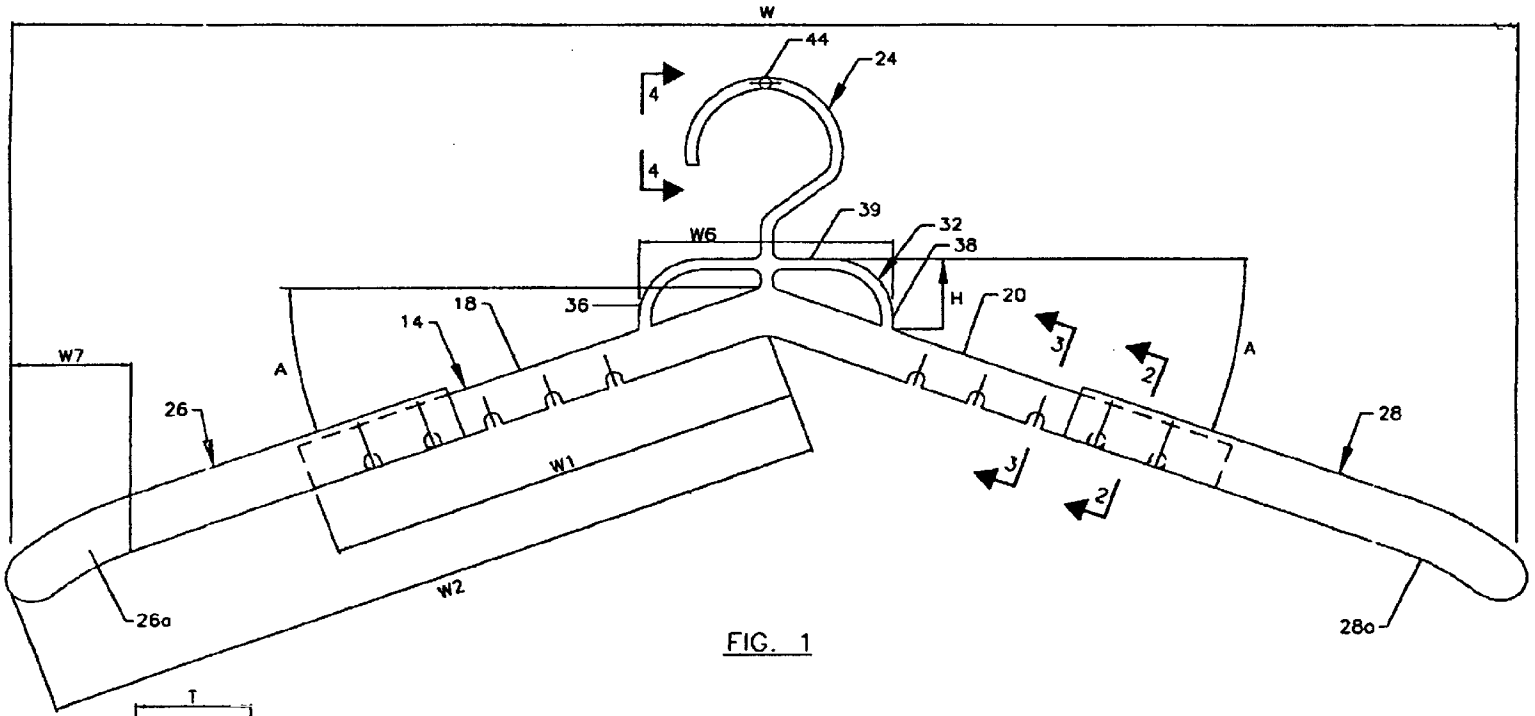
FIG. 1 is an elevational view of a clothing hanger of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a garment hanger 10 comprising a hanger body 14 having laterally extending legs 18, 20. The legs 18, 20 extend at an angle A to the horizontal. Preferably, A is about 20°. The hanger body is connected to a rod-engageable or hook-engageable end member, such as a hook-shaped member 24 that extends from a central region of the hanger body. The hook-shaped member 24 is configured to engage a support rod or hook for suspending the garment hanger.

First and second leg extensions 26, 28 are each adjustably engaged to a leg 18, 20 of the hanger body to determine an overall width W, in the hanger widthwise direction, of the garment hanger.

A collar support 32 extends upwardly from the hanger body 14. The collar support comprises first and second posts 36, 38, each extending at an angle to a respective one of the legs 18, 20. The first and second posts are spaced apart by a distance approximating the flat widthwise dimension of a garment collar.

The collar support 32 further comprises a generally horizontal strut 39 connecting together the posts 36, 38 and the hook-shaped member 24. Preferably, the posts 36, 38 are spaced apart such that the overall dimension in the widthwise direction of the collar support 32 is approximately four inches. The posts 36, 38 extend vertically from the legs 18, 20 to a height H of about one inch.

The hook-shaped member 24 is in the form of an arcuate wire or rod, preferably about 3/16 inch diameter, and the posts 36, 38 and the strut 39 together are in the form of a shaped wire or rod and comprises a substantially equal cross-sectional thickness as the hook-shaped member 24.

Figure 3:
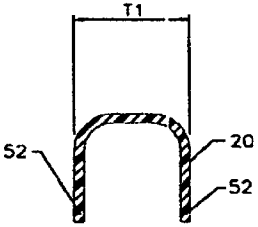
FIG. 3 is a sectional view taken generally along line 3—3 from FIG. 1.
Figure 2:
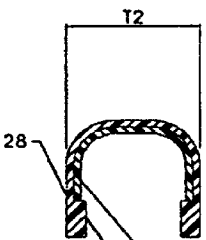
FIG. 2 is a sectional view taken generally along line 2—2 from FIG. 1.

As illustrated in FIGS. 2 and 3 the legs 18, 20 and the leg extensions 26, 28 have inverted U-shaped cross-sections and are telescopically engaged. The legs 18, 20 have an overall thickness T1 in the profile direction. The leg extensions 26, 28 have an overall thickness T2 in the profile direction. The leg extensions have downwardly-curved end portions 26*a*, 28*a*. The end portions 26*a*, 28*a* are also flared outwardly.

Figure 4:
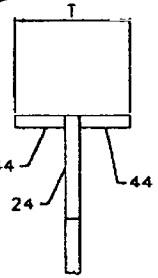
FIG. 4 is a fragmentary left side view of the hanger shown in FIG. 1 viewed along line 4—4.
Figure 8:
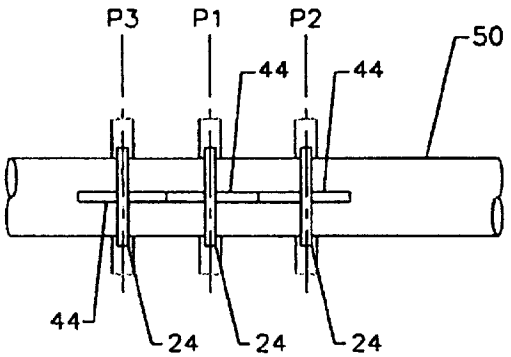
FIG. 8 is a top view of a plurality of hangers of the invention, hung on a rod.

As illustrated in FIGS. 4 and 8, the garment hanger further comprises a spacer 44 extending on opposite sides of the hook-shaped member in a horizontal, "profile" direction that is perpendicular to the widthwise direction, the spacer having a dimension T in the profile direction approximately equal to an overall thickness of each of the extending leg extensions 26, 28 taken along the profile direction. The spacer 44 is preferably in the form of a 3/16" diameter rod.

As illustrated in FIG. 8, the spacer 44 functions to space the hanger center plane P1 a pre-selected distance from center planes P2, P3 of adjacent hangers, hung on a common rod 50, to prevent excessive contact on a garment hung on the hanger 10 by adjacent hung garments.

Figure 5:
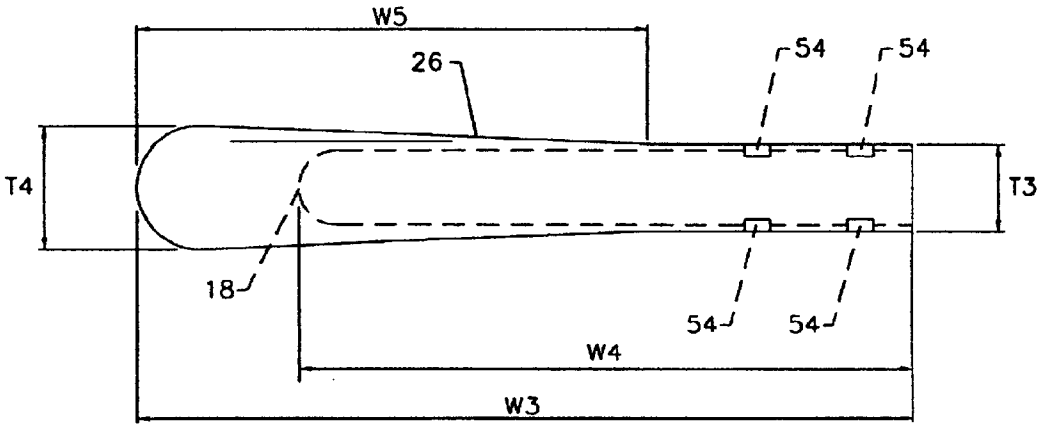
FIG. 5 is a top view of an extension member of the hanger shown in FIG. 1.

FIG. 5 illustrates the leg extension 26, identical to extension 28, being flared along the distance W5 to the distal end. The smallest overall thickness T3 flares to a widest overall thickness T4. The leg 18 can extend into the extension 26 the distance L4.

Figure 7:
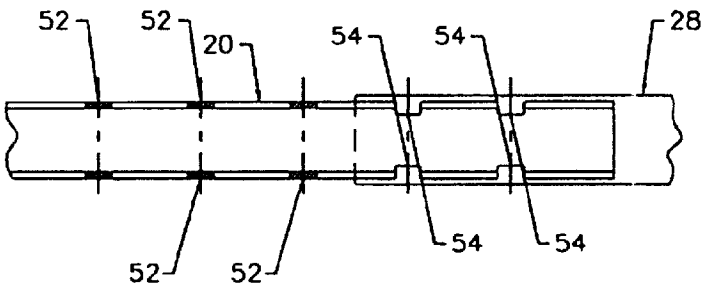
FIG. 7 is a fragmentary bottom view of the hanger shown in FIG. 1.
Figure 6:
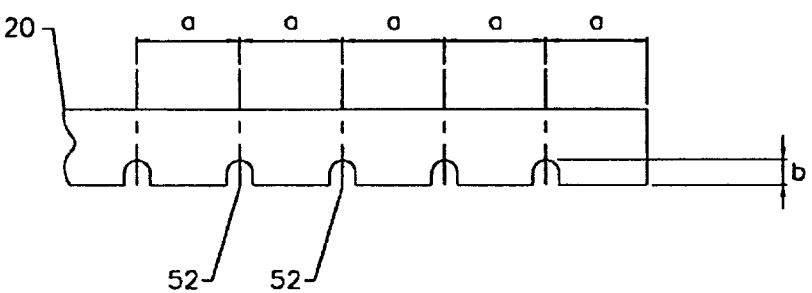
FIG. 6 is a fragmentary elevational view of a leg shown in FIG. 1.

As illustrated in FIGS. 6 and 7, the leg 20, and likewise the mirror image identical leg 18, comprises incrementally spaced-apart notches 52 and the leg extension 28, and likewise the identical leg extension 26, comprises at least one lug or button, advantageously four lugs 54, sized and shaped to fit into selected notches 52 to adjust the degree of telescopic engagement of the respective leg and leg extension pair.

FIG. 6 illustrates the leg 20 having the notches 52 spaced along its length on both legs of the U-shaped cross section of leg 20. The notches have a height of b.

FIG. 7 illustrates the leg extension 28 engaged to the leg 20. The four buttons 54 enter into, and extend beyond, four notches 52. Preferably the buttons are ¼" diameter solid cylinders.

The hanger body, hook-shaped member and the collar support are molded in unitary fashion of a plastic material, and the leg extensions are also composed of plastic material.

The preferred embodiment hanger 10 has the following exemplary dimensions:

| | | | | |
|---|---|---|---|---|
| W = 23½" | H = 1 3/16" | W2 = 11¾" | W4 = 5 15/16" | a = 1" |
| T = 1" | T1 = ¾" | W1 = 7½" | W3 = 7 9/16" | W5 = 5" |
| b = ¼" | T2 = ⅞" | T3 = ⅞" | T4 = 1¼" | W6 = 4" |
| W7 = 2⅛" | | | | |

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A garment hanger comprising:

a hanger body having laterally extending legs;

a hook-shaped member extending from a central region of said hanger body, said hook-shaped member configured to engage a support rod for suspending said garment hanger;

first and second leg extensions each adjustably engaged to a leg of said hanger body to determine an overall width along a horizontal, widthwise direction, said horizontal, widthwise direction is along a shoulder-to-shoulder direction of a garment hung on the hanger;

a collar support comprising first and second substantially vertical portions each extending at an angle to a respective one of said legs, said first and second substantially vertical portions spaced apart by a distance approximating the width of a garment collar, and a connecting portion connected between ends of said first and second substantially vertical portions, said first and second substantially vertical portions and said connecting portion being a rigid piece that is rigidly connected to said first and second legs.

2. The garment hanger according to claim 1, further comprising a spacer extending on opposite sides of said hook-shaped member in a horizontal, profile direction perpendicular to said horizontal, widthwise direction, said spacer having a thickness in said horizontal, profile direction approximately equal to, or greater than, an overall thickness of said extending legs taken along the horizontal, profile direction.

3. The garment hanger according to claim 1, wherein said legs and said leg extensions have inverted U-shaped cross-sections and are telescopically engaged.

4. The garment hanger according to claim 3, wherein for each pair of leg and leg extension, one of said leg and leg extension comprises incrementally spaced-apart openings and the other of said leg and leg extension comprises at least one lug sized and shaped to fit into a selected one of said openings to adjust the degree of telescopic engagement of said leg and leg extension.

5. The garment hanger according to claim 1, wherein said leg extensions have an overall thickness in said horizontal, profile direction of about one inch.

6. The garment hanger according to claim 1, wherein said leg extensions have downwardly angled ends.

7. The garment hanger according to claim 1, wherein said connecting portion comprises a generally horizontal strut and said first and second substantially vertical portions comprise posts, said strut connecting together said posts and said hook-shaped member.

8. The garment hanger according to claim 1, wherein said substantially vertical portions are spaced apart such that the overall length in the widthwise direction of the collar support is approximately four inches.

9. The garment hanger according to claim 1, wherein said substantially vertical portions extend vertically from said legs to a height of about one inch.

10. The garment hanger according to claim 1, wherein said legs and said leg extensions together comprise openings and engagement lugs applied on opposite ones of said legs and leg extensions and numbered such that an excess number of either openings or lugs is present to provide for an incremental adjustability in the overall width of the legs and leg extensions taken along the widthwise direction.

11. The garment hanger according to claim 1, wherein said leg extensions have flared ends.

12. The garment hanger according to claim 1, wherein said hook-shaped member is in the form of an arcuate wire, and said connecting portion comprises a substantially equal cross-sectional dimension.

13. A garment hanger comprising:

a hanger body having laterally extending legs;

a hook-shaped member extending from a central region of said hanger body, said hook-shaped member configured to engage a support rod for suspending said garment hanger;

first and second leg extensions each adjustably engaged to a leg of said hanger body to determine an overall width along a horizontal, widthwise direction, said horizontal, widthwise direction is along a shoulder-to-shoulder direction of a garment hung on the hanger;

a collar support comprising first and second substantially vertical portions each extending at an angle to a respective one of said legs, said first and second substantially vertical portions spaced apart by a distance approximating the width of a garment collar, and a connecting portion connected between ends of said first and second substantially vertical portions, said first and second substantially vertical portions and said connecting portion being a rigid piece that is rigidly connected to said first and second legs;

wherein said hanger body, said hook shaped member and said collar support are molded as one piece in unitary fashion of a plastic material, and said leg extensions also are composed of plastic material.

14. A garment hanger comprising:

a hanger body having laterally extending legs;

a hook-shaped member extending from a central region of said hanger body, said hook-shaped member configured to engage a support rod for suspending said garment hanger;

first and second leg extensions each adjustably engaged to a leg of said hanger body to determine an overall width along a widthwise direction, said widthwise direction is along a shoulder-to-shoulder direction of a garment hung on the hanger; and a spacer extending on opposite sides of said hook-shaped member in a horizontal, profile direction perpendicular to said widthwise direction, said spacer having a thickness in said horizontal, profile direction approximately equal to, or greater than, an overall thickness of said extending legs taken along the horizontal, profile direction, wherein said hook-shaped member and said spacer are molded in unitary fashion of a plastic material.

15. The garment hanger according to claim 14, further comprising a collar support comprising first and second posts each extending at an angle to a respective one of said legs, said first and second posts spaced apart by a distance approximating the width of a garment collar, wherein said collar support further comprises a generally horizontal strut connecting together said posts and said hook-shaped member, said collar support molded in unitary fashion of said plastic material with said hook-shaped member.

16. The garment hanger according to claim 14, wherein said legs and said leg extensions have inverted U-shaped cross-sections and are telescopically engaged.

17. The garment hanger according to claim 16, wherein for each pair of leg and leg extension, one of said leg and leg extension comprises incrementally spaced-apart openings and the other of said leg and leg extension comprises at least one lug sized and shaped to fit into a selected one of said openings to adjust the degree of telescopic engagement of said leg and leg extension.

18. The garment hanger according to claim 14, wherein said legs and said leg extensions together comprise openings and engagement lugs applied on opposite ones of said legs and leg extensions and numbered such that an excess number of either openings or lugs is present to provide for an incremental adjustability in the overall width of the legs and leg extensions taken along the widthwise direction.

19. The garment hanger according to claim 14, wherein said hanger body, said hook shaped member and said spacer are molded in unitary fashion of a plastic material, and said leg extensions also are composed of plastic material.

20. A garment hanger comprising:

a hanger body having laterally extending legs;

a hook-shaped member extending from a central region of said hanger body, said hook-shaped member configured to engage a support rod for suspending said garment hanger;

first and second leg extensions each adjustably engaged to a leg of said hanger body to determine an overall width along a horizontal, widthwise direction, said horizontal, widthwise direction is along a shoulder-to-shoulder direction of a garment hung on the hanger, wherein said legs and said leg extensions have inverted U-shaped cross-sections and are telescopically engaged;

a collar support comprising first and second posts each extending at an angle to a respective one of said legs, said first and second posts spaced apart by a distance approximating the width of a garment collar;

wherein for each pair of leg and leg extension, one of said leg and leg extension comprises greater than four incrementally spaced-apart openings and the other of said leg and leg extension comprises four lugs arranged in a rectangular pattern and sized and shaped to fit into a selected four of said openings to adjust the degree of telescopic engagement of said leg and leg extension.

21. The garment hanger according to claim 20, wherein said hanger body, said hook shaped member and said collar support are molded in unitary fashion of a plastic material, and said leg extensions also are composed of plastic material.

22. A garment hanger comprising:

a hanger body having laterally extending legs;

a hook-shaped member extending from a central region of said hanger body, said hook-shaped member configured to engage a support rod for suspending said garment hanger;

first and second leg extensions each adjustably engaged to a leg of said hanger body to determine an overall width along a widthwise direction, said widthwise direction is along a shoulder-to-shoulder direction of a garment hung on the hanger; and a spacer extending on opposite sides of said hook-shaped member in a horizontal, profile direction perpendicular to said widthwise direction, said spacer having a thickness in said horizontal, profile direction approximately equal to, or greater than, an overall thickness of said extending legs taken along the horizontal, profile direction;

wherein said legs and said leg extensions have inverted U-shaped cross-sections and are telescopically engaged for each pair of leg and leg extension, and one of said leg and leg extension comprises greater than four incrementally spaced-apart openings and the other of said leg and leg extension comprises four lugs arranged in a rectangular pattern and sized and shaped to fit into a selected four of said openings to adjust the degree of telescopic engagement of said leg and leg extension.

23. The garment hanger according to claim 22, wherein said openings comprise notches.

24. The garment hanger according to claim 20, wherein said openings comprise notches.

25. The garment hanger according to claim 24, wherein Said hanger body, said hook shaped member and said collar support are molded in unitary fashion of a plastic material, and said leg extensions also are composed of plastic material.

26. The garment hanger according to claim 15, wherein said legs and said leg extensions have inverted U-shaped cross-sections and are telescopically engaged for each pair of leg and leg extension, and one of said leg and leg extension comprises greater than four incrementally spaced-apart openings and the other of said leg and leg extension comprises four lugs arranged in a rectangular pattern end sized and shaped to fit into a selected four of said openings to adjust the degree of telescopic engagement of said leg and leg extension.

* * * * *

UNITED STATES PATENT AND TRADEMARK OFFICE

CERTIFICATE OF CORRECTION

PATENT NO. : 6,811,064 B2
DATED : November 2, 2004
INVENTOR(S) : Charles L. Salem It is certified that error appears in the above-identified patent and that said Letters Patent is hereby corrected as shown below:

Column 8,
Line 9, correct “Said” to -- said --.
Line 20, correct “end” to -- and --.

Signed and Sealed this

Tenth Day of May, 2005

JON W. DUDAS
*Director of the United States Patent and Trademark Office*